US006227260B1

(12) United States Patent
Kometani

(10) Patent No.: US 6,227,260 B1
(45) Date of Patent: May 8, 2001

(54) WIRE CURVATURE CORRECTING DEVICE IN PRESSURE CONNECTION OF WIRE

(75) Inventor: Toshio Kometani, Nagoya (JP)

(73) Assignees: Harness System Technologies Research, Ltd., Nagoya; Sumitomo Wiring Systems, Ltd., Mie; Sumitomo Electric Industries, Ltd., Osaka, all of (JP)

( * ) Notice: Subject to any disclaimer, the term of this patent is extended or adjusted under 35 U.S.C. 154(b) by 0 days.

(21) Appl. No.: 09/391,233

(22) Filed: Sep. 7, 1999

(30) Foreign Application Priority Data

Dec. 9, 1998 (JP) ..... 10-349959

(51) Int. Cl.[7] ..... H01R 43/01
(52) U.S. Cl. ..... 140/147; 29/748
(58) Field of Search ..... 29/748, 755; 140/147, 140/102

(56) References Cited

U.S. PATENT DOCUMENTS 3,029,494 4/1962 Andren .
3,948,298 * 4/1976 Braden ..... 140/147
4,367,584 * 1/1983 Janisiewicz et al. ..... 140/147
4,653,159 * 3/1987 Henderson et al. ..... 29/748
5,791,037 8/1998 Takada et al. .

FOREIGN PATENT DOCUMENTS 0 844 703 A1 5/1998 (EP) .

* cited by examiner

*Primary Examiner*—Lowell A. Larson
(74) *Attorney, Agent, or Firm*—Oliff & Berridge, PLC

(57) ABSTRACT

When a wire "a" is pressed into a pressure connection terminal of a connector C, an end portion of the wire "a" is clamped by a wire curvature correcting chuck 47, and the wire curvature correcting chuck 47 is slid in a pulling direction along the surface of a sheathing of the wire "a" in a state in which the feeding of the wire "a" is stopped, thereby correcting a curvature in the wire "a" so as to allow a press-in blade S to reliably grip the wire "a" and depress the same. In addition, in conjunction with the retraction of the wire curvature correcting chuck 47, its open/closed state is monitored by an opening/closing sensor to detect the amount of the projecting allowance of the wire "a" with respect to pressure connection, and a required measure can be adopted if the projecting allowance is insufficient.

4 Claims, 8 Drawing Sheets

WIRE CURVATURE CORRECTING DEVICE IN PRESSURE CONNECTION OF WIRE

BACKGROUND OF THE INVENTION

The present invention relates to a wire curvature correcting device for correcting curvature of wires which are pressure-connected to a connector at the time of manufacturing a wire harness.

As an example of a wire harness for an automobile in which connectors are attached to both ends of wires arranged in parallel, one shown in FIG. 7 is known. In this wire harness, eight wires "a" are connected to one connector C at one end thereof (hereafter referred to as the "A" end), and four wires "a" are connected to two connectors C, respectively, at the other end thereof (hereafter referred to as the "B" end).

Pressure connection (insulation displacement connection) such as the one shown in FIG. 8 is adopted as the means of connecting the wires "a" to the connector C by taking into account operational features and the like. In this pressure connection, the wires "a" are pressed into grooves 60 in pressure connection terminals T, which are provided in each connector C, by being depressed by a press-in blade S. In conjunction with the pressing in, a sheathing 62 surrounding a bundle of conductors 61 of each wire "a" is cut off at side edges of the groove 60, and the bared bundle of conductors 61 is brought into contact with the pressure connection terminal T, and each wire "a" is held in the groove 60 by the springing back of the pressure connection terminal T. Then, after the pressing in of the wires "a" into the pressure connection terminal T, the connector C is covered with a terminal cover L so as to prevent the wires "a" from coming off, as shown in FIG. 9.

As the apparatus for manufacturing a wire harness for effecting such pressure connection, an apparatus is conceivable which grips the end portion of the wire "a" by means of a chuck so as to convey the end portion of the wire "a" to the wire pressure-connection section having the press-in blade S.

In the above-described pressure connection, there are cases where if there is a curvature in the end portion of the wire "a", the wire "a" escapes from below the press-in blade S at the time of pressing the wire "a" into the terminal T, thus making it impossible to depress the wire "a" by means of the press-in blade S.

In addition, there are cases where if a projecting allowance of the wire "a" from the chuck gripping the wire "a" is insufficient, the wire "a" cannot reach the groove 60 in the terminal T.

SUMMARY OF THE INVENTION

Accordingly, an object of the present invention is to correct curvature in wires which are pressure-connected to the terminals of the connectors and to confirm the projecting allowance of each wire, so as to render the pressure connection reliable.

To attain the above-described object, in accordance with the present invention there is provided a wire curvature correcting device wherein, when a wire is pressed into a pressure connection terminal of a connector, and a wire curvature correcting chuck which has clamped an end portion of the wire is slid in a pulling direction along a surface of a sheathing of the wire, thereby making it possible to allow a press-in blade to reliably grip the wire and depress the same.

In addition, an arrangement is provided such that, in conjunction with the retraction of the wire curvature correcting chuck, its open/closed state is monitored by an opening/closing sensor to detect the amount of the projecting allowance of the wire with respect to pressure connection, and a required measure can be adopted if the projecting allowance is insufficient.

DETAILED DESCRIPTION OF THE PREFERRED EMBODIMENTS

Referring now to the accompanying drawings, a description will be given of an example in which an embodiment of a wire curvature correcting device in accordance with the present invention is applied to a wire harness manufacturing apparatus.

Figure 1:
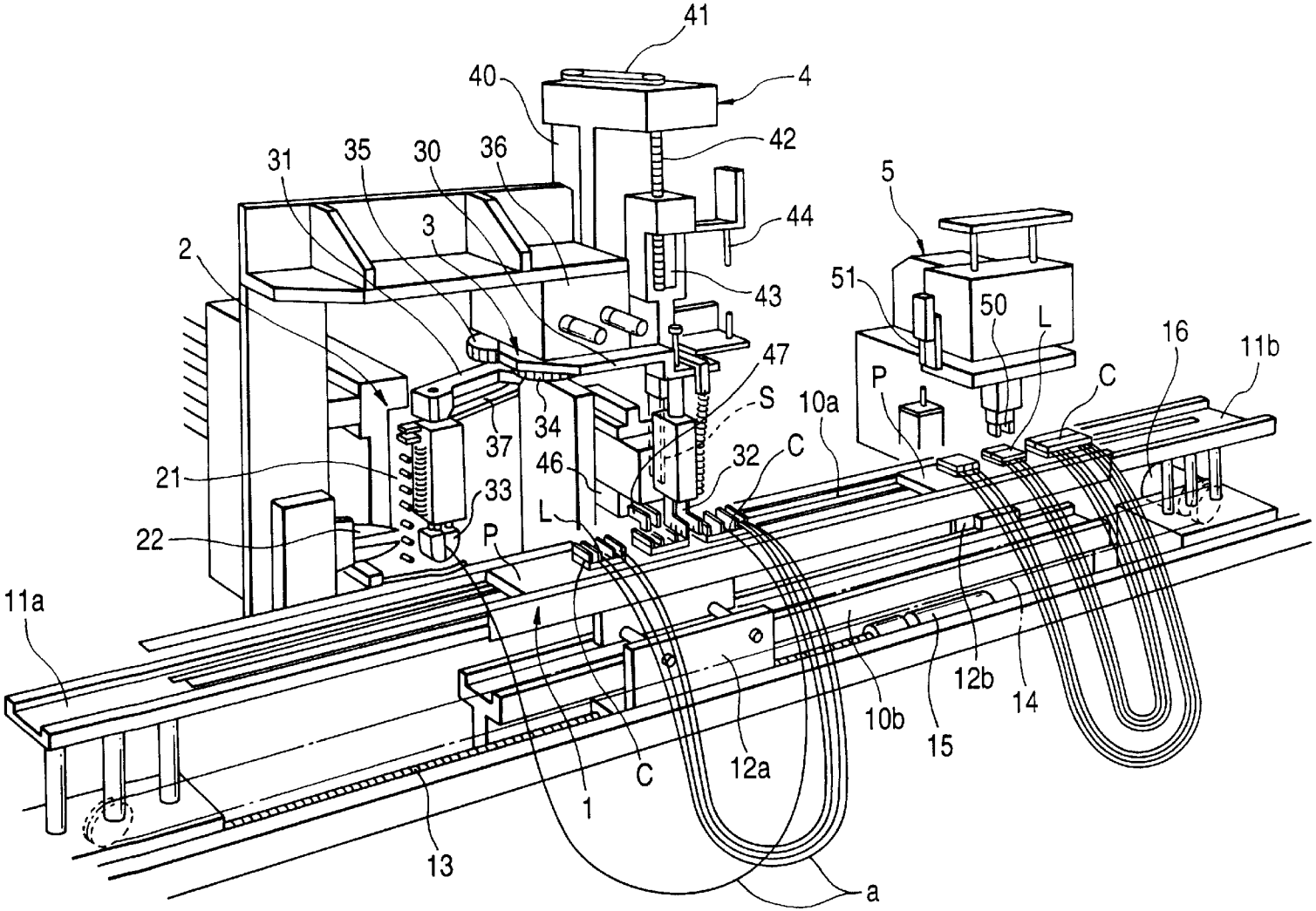
FIG. 1 is an overall perspective view illustrating an embodiment of the present invention.

As shown in FIG. 1, this wire harness manufacturing apparatus is comprised of a pallet feeding section 1, a wire supplying section 2, a wire setting section 3, a pressure-connecting head section (wire pressure-connecting section) 4, and a cover fitting section 5.

The pallet feeding section 1 includes two guide rails 10*a* and 10*b* arranged in upper and lower stages for guiding a pallet P on which a plurality of connectors C are juxtaposed; two lifts 11*a* and 11*b* respectively located on both sides thereof to deliver the pallet P between the guide rails 10*a* and 10*b*; and two carriages 12*a* and 12*b* for moving the pallet P along the guide rail 10*a* or 10*b*. The carriage 12*a* is threadedly engaged on a screw shaft 13 by means of a ball screw structure, while the carriage 12*b* is secured to an endless belt 14 trained between a pair of pulleys, the respective carriages being adapted to travel as servo motors 15 and 16 are driven.

Figure 2:
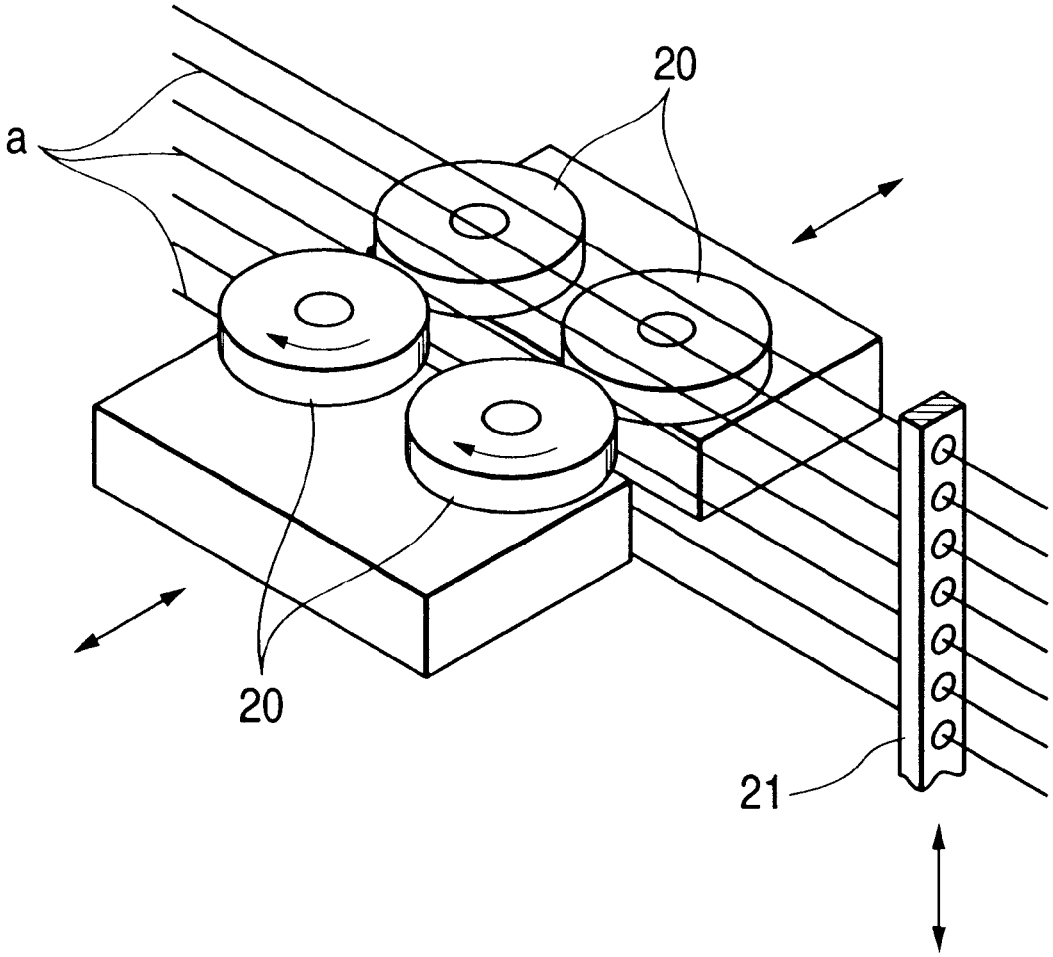
FIG. 2 is a schematic perspective view of a wire supplying section of the embodiment.

As shown in FIGS. 1 and 2, the wire supplying section 2 includes two pairs of rollers 20, which are adapted to move toward and away from each other, and a lifting member 21 for lifting or lowering in a vertically parallel state a multiplicity of wires "a" to be formed into the harness. Through the operation of the lifting member 21, the wire supplying section 2 positions the wire "a" to be pressure-connected next at the level of the rollers 20, clamps that wire "a" by the pairs of rollers 20, and feeds it a predetermined length. Provided in front of the wire supplying section 2 are clippers 22 adapted to advance or retract with respect to a feeding hole for the wire "a" as well as a supporting bar 23 which can be raised or lowered.

Figure 3A:
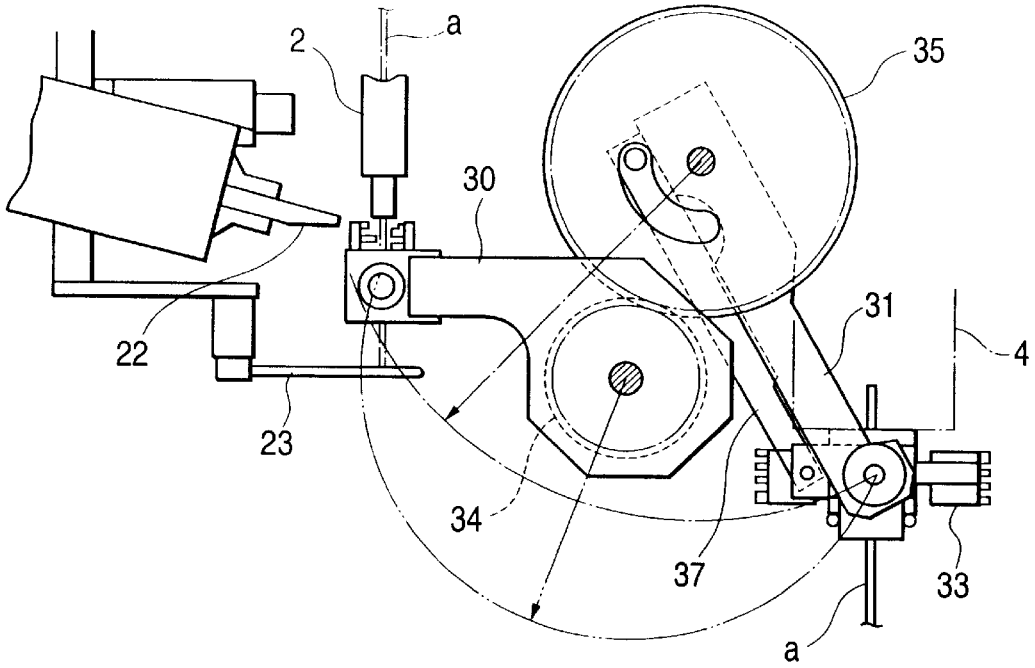
FIG. 3A is a plan view illustrating a state of a wire setting section of the embodiment.
Figure 3B:
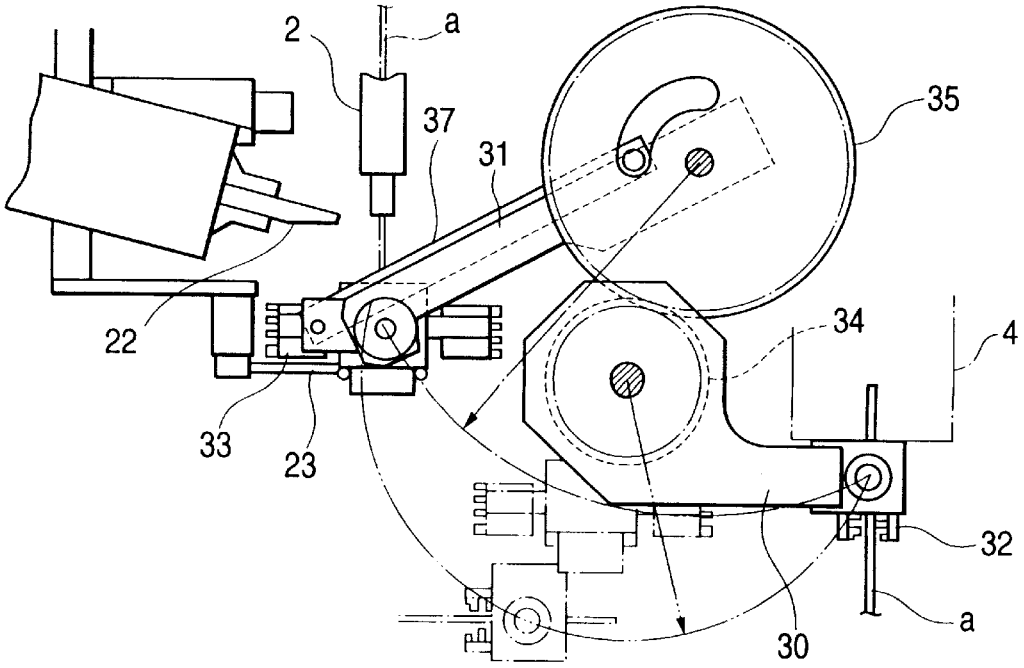
FIG. 3B is a plan view illustrating another state of the embodiment.

As shown in FIGS. 1 and 3, the wire setting section 3 has two swing arms 30 and 31, and an A-end chuck 32 and a B-end chuck 33 for respectively gripping the A end and the B end are provided on distal end portions of the swing arms 30 and 31. The swing arms 30 and 31 are threadedly engaged with each other by gears 34 and 35 at their proximal ends, and are simultaneously swung in opposite directions by the same driving motor 36. At the time of this swinging motion, since the distal end portions of the swing arms 30 and 31 pass along different paths, the A-end chuck 32 and the B-end chuck 33 do not interfere with each other. Here, a link 37, which forms a parallel crank mechanism together with the swing arm 31, is connected to one side of the B-end chuck 33, whereby the B-end chuck 33 is adapted to face the same direction at all times. It should be noted that the A-end chuck 32 and the B-end chuck 33 function as conveying chucks for conveying the respective end portions of the wires "a" to the pressure-connecting head section 4 in conjunction with the swinging motion of the swing arms 30 and 31.

Figure 4:
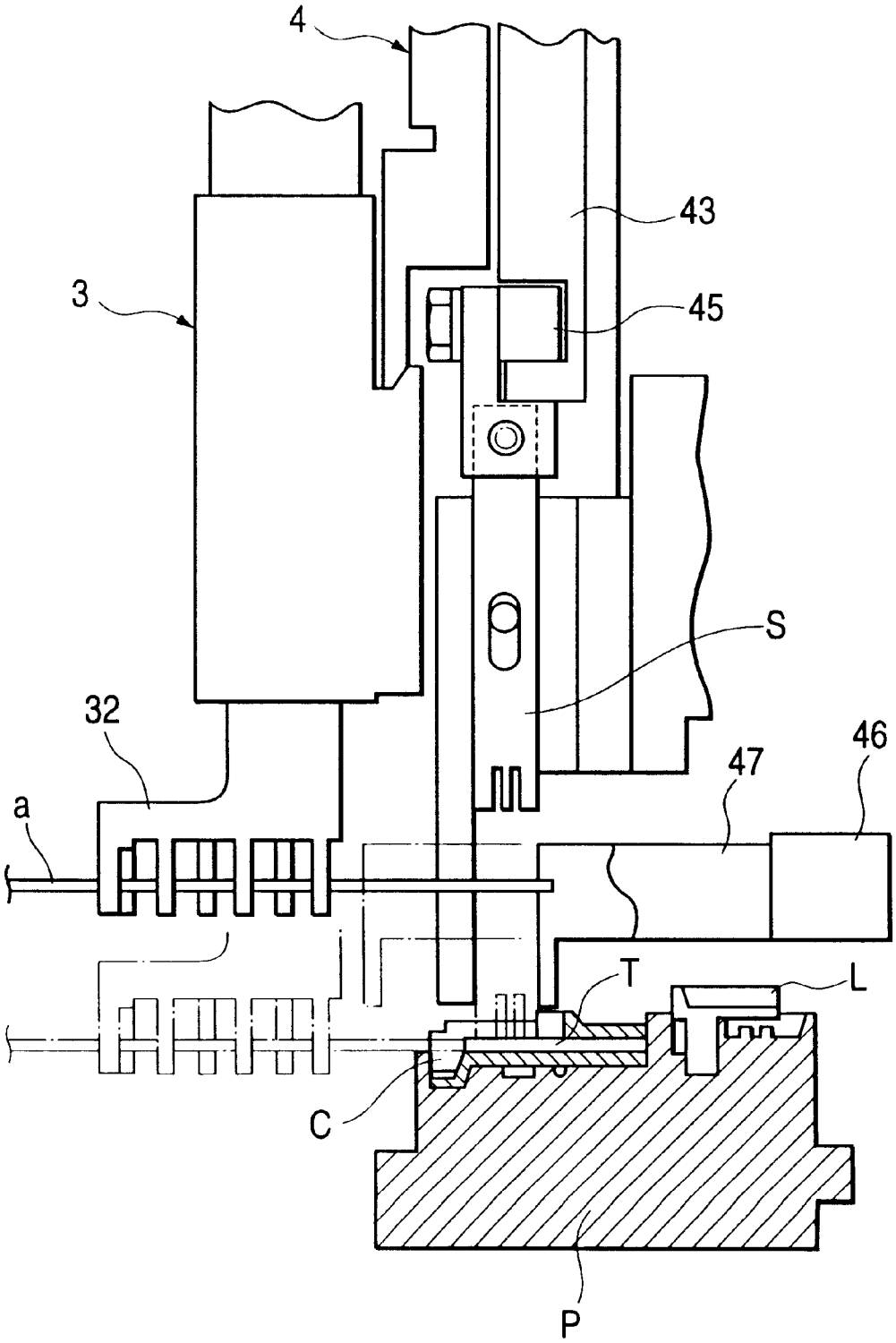
FIG. 4 is a right-hand side view of a pressure-connecting head section of the embodiment.
Figure 5:
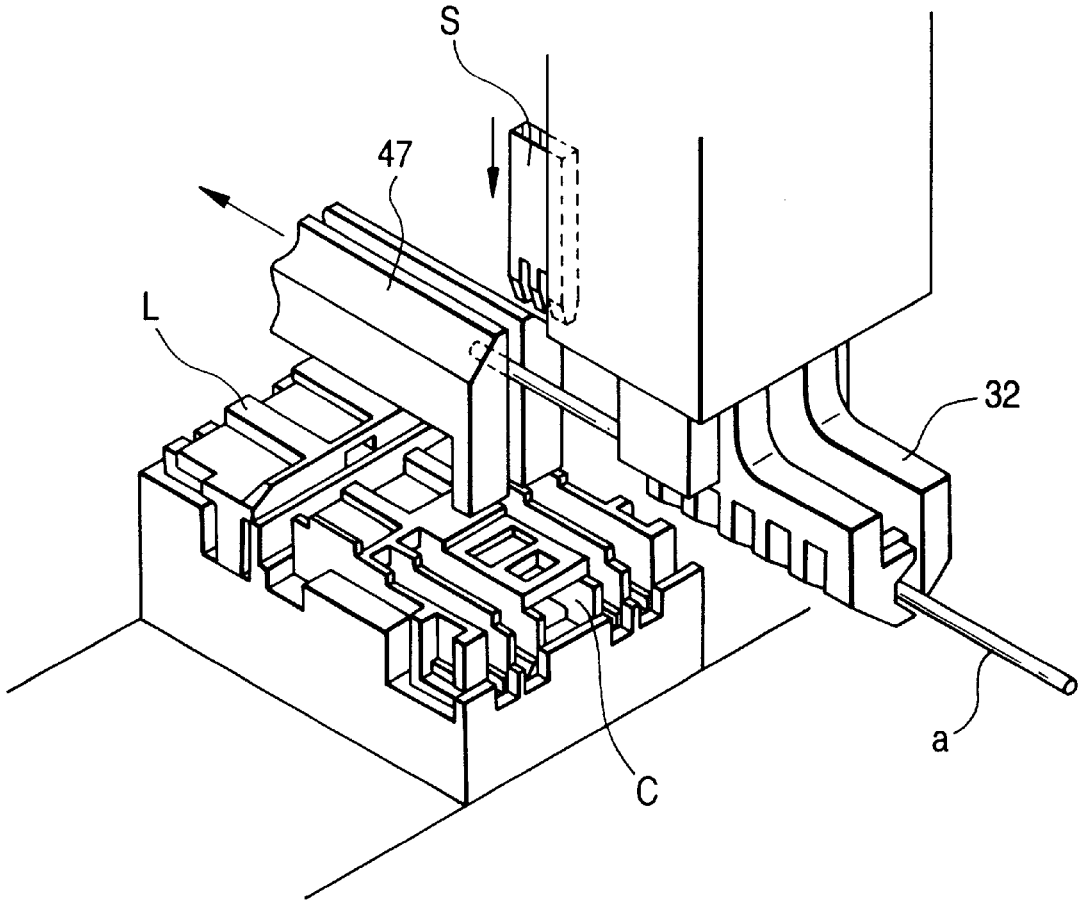
FIG. 5 is a schematic perspective view illustrating the operation of a wire curvature correcting chuck of the embodiment.

As shown in FIGS. 1, 4 and 5, the pressure-connecting head section 4 causes a screw shaft 42 to rotate via a belt 41 by driving 15 a servo motor 40, and raises or lowers a press-in blade S provided at a lower end of a raising/lowering rod 43 which is threadedly engaged with the screw shaft 42 in a ball screw structure, so as to depress the A-end chuck 32 or the B-end chuck 33 in conjunction with the lowering of the raising/lowering rod 43. This pressure-connecting head section 4 is provided with a linear scale 44 for detecting the height of the raising/lowering rod 43 from a reference position as well as a load cell 45 for detecting a reaction force from the press-in blade S.

In addition, a wire curvature correcting device 46 in accordance with the present invention is provided below the pressure-connecting head section 4. This wire curvature correcting device 46 is comprised of a wire curvature correcting chuck 47 which moves back and forth after gripping the end portion of the wire "a" projecting from the A-end chuck 32 or the B-end chuck 33, as well as an opening/closing sensor (not shown) therefor.

Figure 6:
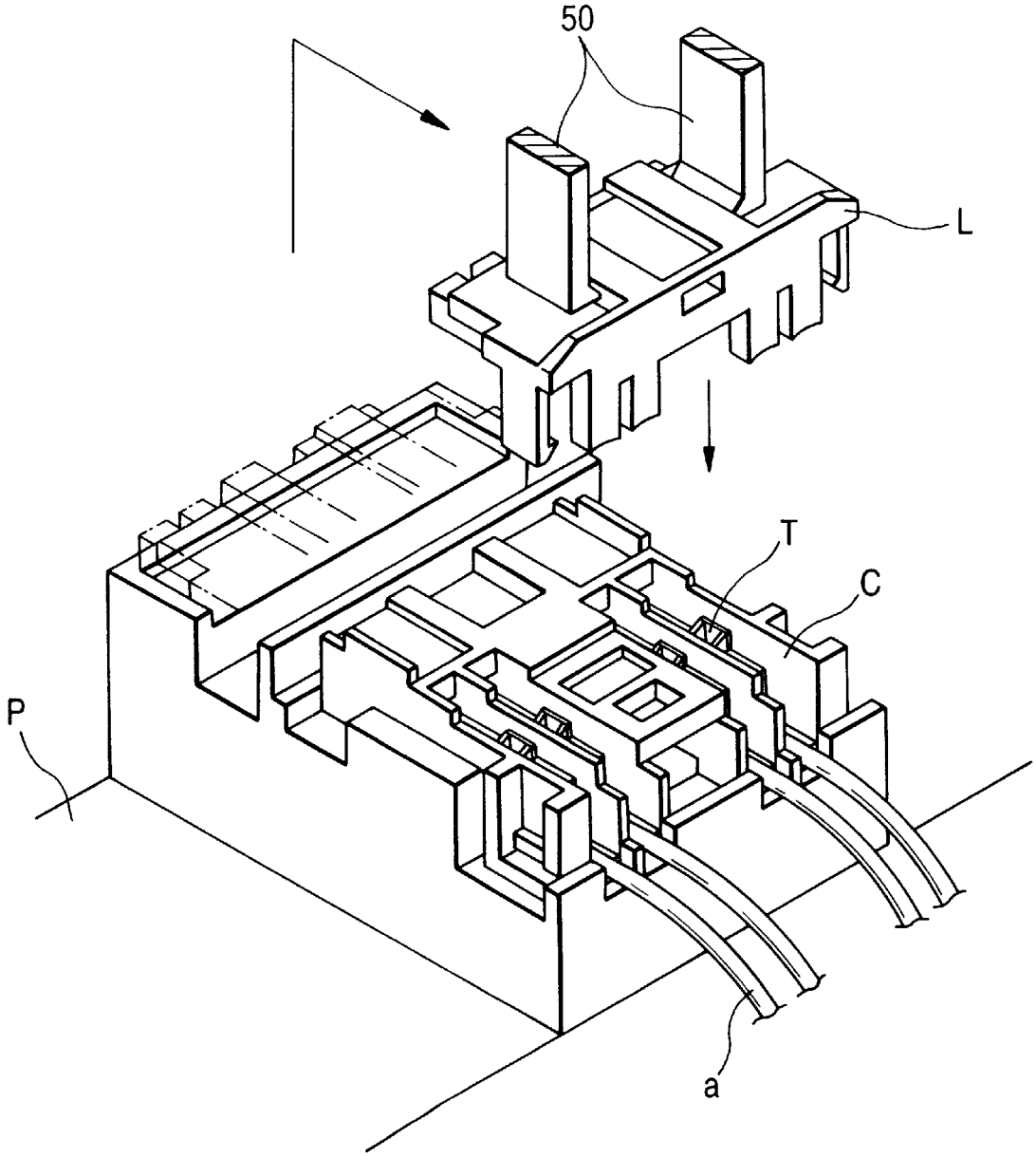
FIG. 6 is a schematic perspective view illustrating the operation of a cover fitting section of the embodiment.

As shown in FIGS. 1 and 6, the cover fitting section 5 has a cover gripping chuck 50 which is raised or lowered and moves back and forth by the driving of a cylinder or the like, and this cover fitting section 5 is provided with a linear scale 51 for detecting the height of the cover gripping chuck 50 from a reference position.

Figure 7:
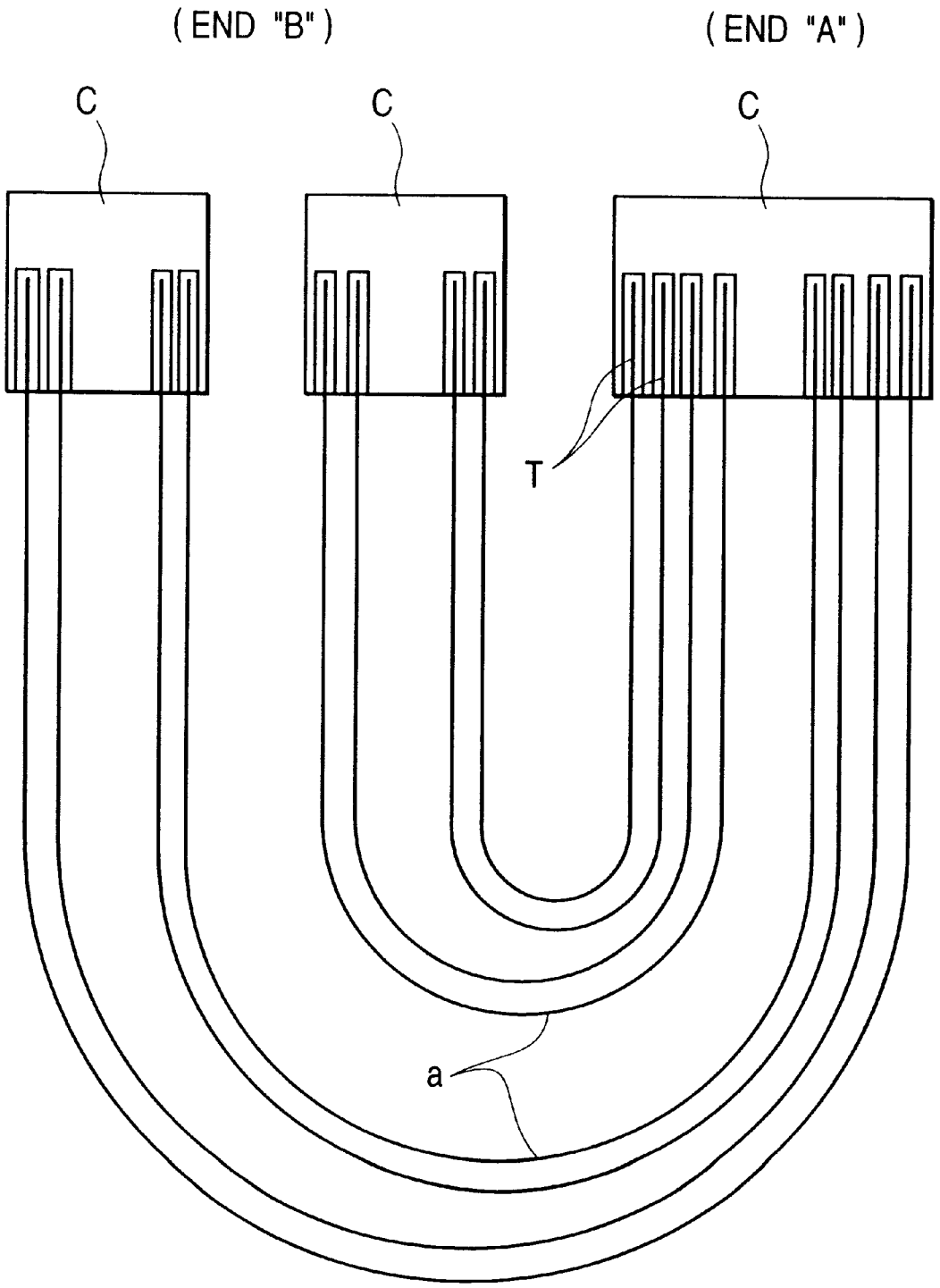
FIG. 7 is a schematic plan view illustrating an example of a wire harness.
Figure 8:
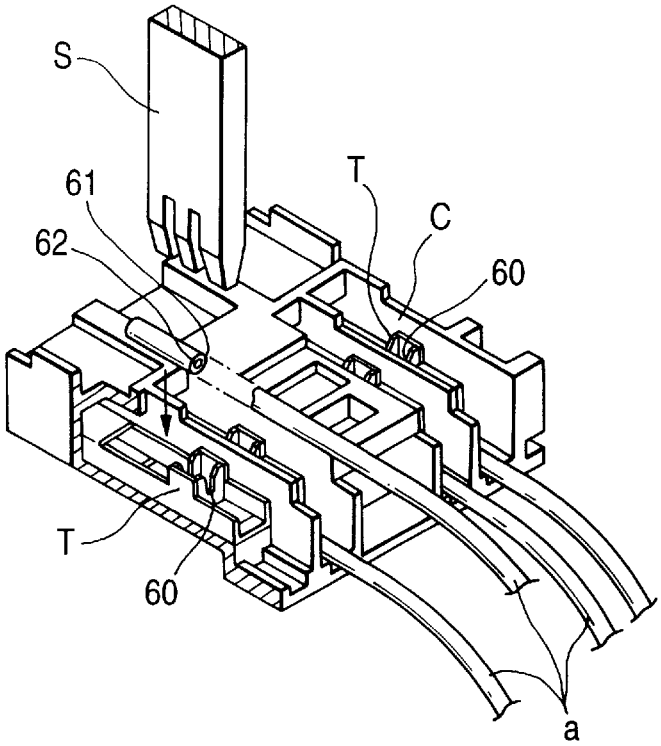
FIG. 8 is a perspective view illustrating the pressure connection of a wire to a connector terminal.
Figure 9:
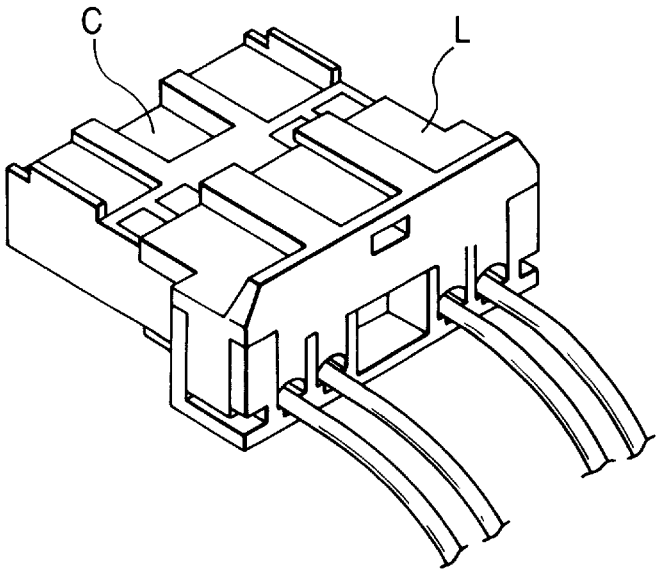
FIG. 9 is a perspective view of a connector with a terminal cover fitted thereon.

To manufacture the wire harness such as the one shown in FIG. 7 by using the above-described wire harness manufacturing apparatus, the three connectors C corresponding to the "A" end and the "B" end of the wire harness as well as terminal covers L are juxtaposed on the pallet P on the lift 11*b* which is at its raised position. Then, the lift 11*b* is lowered, and this pallet P is sent to the lift 11*a*, which is at its lowered position, by means of the guide rail 10*b* in conjunction with the traveling of the carriage 12*b*.

Subsequently, the engagement between the carriage 12*b* and the pallet P is canceled, the lift 11*a* is raised, and the carriage 12*b* is engaged with the pallet P. In conjunction with the traveling of the carriage 12*a*, the pallet P is moved onto the guide rail 10*a*, and the terminal T of the connector C to which the wires "a" are first pressure-connected is positioned below the press-in blade S. This positioning is effected by a program set in advance.

Next, the first wire "a" set in advance by the program is slightly fed from the wire supplying section 2, its leading end portion is clamped by the A-end chuck 32 [see FIG. 3(*a*)], and the A-end chuck 32 is positioned in front of the pressure-connecting head section 4 by swinging the swing arm 30 while further feeding the wire "a" [see FIG. 3(*b*)].

Then, the feeding of the wire "a" is stopped, the leading end portion of the wire "a" projecting from the A-end chuck 32 is clamped by the wire curvature correcting chuck 47 as shown in FIGS. 4 and 5, and this chuck 47 is slid in the pulling direction along the surface of the sheathing of the wire "a", thereby correcting the curvature in the wire "a" to a straight state. By virtue of this correction, the wire "a" can be reliably caught by the press-in blade S and can be depressed.

In addition, at this time, by detecting whether or not the wire curvature correcting chuck 47 has clamped the wire "a" by means of the opening/closing sensor, whether the projecting allowance of the wire "a" is sufficient or insufficient with respect to the pressure connection is determined by the program. If the projecting allowance is insufficient, the operation of the wire harness manufacturing apparatus is temporarily stopped, and a necessary measure such as a manual operation is taken.

Subsequently, the press-in blade S of the pressure-connecting head section 4 is lowered together with the A-end chuck 32, and the leading end portion of the wire "a" is pressed into the groove in the terminal T of the predetermined connector C. This pressed-in height is set in advance to an optimum value by a control program of the servo motor 40. Then, whether the pressed-in state is good or bad is determined by the program by measuring this pressed-in height by the linear scale 44 and by measuring the pressing-in resistance by the load cell 45.

Meanwhile, concurrently with this pressure connection, the wire "a" which is at a standstill in front of the wire supplying section 2 is gripped by the B-end chuck 33 while being supported by the supporting bar 23, and the clippers 22 is advanced to cut the wire "a" to a predetermined length in the rear of the B-end chuck 33 [see FIG. 3(*b*)].

Then, after completion of the pressure connection of the A end, the swing arm 31 is swung to position the B-end chuck 33 in front of the pressure-connecting head section 4. Concurrently, the clamping of the wire "a" by the A-end chuck 32 is canceled, the swing arm 30 is swung in the opposite direction at the same time as the swing arm 31, and the A-end chuck 32 is positioned in front of the wire supplying section 2 [see FIG. 3(*a*)]. In addition, the pallet P is moved in accordance with the setting of the program so as to allow the terminal T of the connector C at the B end, to which this wire "a" is pressure-connected, to be positioned below the press-in blade S of the pressure-contact head section 4.

Next, the press-in blade S of the pressure-connecting head section 4 is lowered together with the B-end chuck 33, and the rear end portion of the wire "a" is pressed into the groove in the terminal T of the predetermined connector C at the B end. In the same way as the A end side, this pressed-in height is also set in advance to an optimum value by the control program of the servo motor 40. In addition, at the time of pressing in, whether the pressed-in state is good or bad is determined by the program by measuring this pressed-in height by the linear scale 44 and by measuring the pressing-in resistance by the load cell 45.

During the pressure connection of the B end, the wire supplying section 2 effects the operation of feeding the wire "a" to be pressure-connected next, and by repeating the above-described pressure-connecting operation with respect to all the wires "a", the formation of the harness such as the one shown in FIG. 7 is completed.

Subsequently, the engagement of the pallet P and the carriage 12*a* is canceled, the carriage 12*b* is instead engaged with the pallet P, and this pallet P is moved to below the cover fitting section 5.

Then, as shown in FIG. 6, the terminal cover L is gripped and lifted by the cover gripping chuck 50, is moved forward, and is placed on the corresponding connector C. If this operation is consecutively performed for each connector C, the wire harness is completed.

Here, at the time of fitting the terminal cover L, whether the fitted state is good or bad is determined by measuring the height of the terminal cover L from the connector C by the linear scale 51 and by comparing that value and an allowable value by means of the program. Then, only nondefective products are shipped as products.

It should be noted that, after the pressing in of the wire "a" and prior to the fitting of the terminal cover L, if the pressed-in height of the wire "a" is measured by a laser sensor, and the terminal cover L is fitted on only the connector C in which the pressed-in height of all the wires "a" is within an allowance, it is possible to dispense with the trouble of removing the terminal cover L at the time of repairing a product with faulty pressure connection.

As described above, when the wire is pressed into the pressure connection terminal of the connector, if the wire curvature correcting device in accordance with the present invention is used, the wire curvature correcting chuck which has clamped an end portion of the wire slides in the pulling direction along the surface of the sheathing of the wire, thereby correcting the curvature in the wire. Accordingly, it is possible to allow the press-in blade to reliably grip the wire and depress the same, so that an error in pressure connection can be prevented.

In addition, an arrangement is provided such that, in conjunction with the retraction of the wire curvature correcting chuck, its open/closed state is monitored by an opening/closing sensor to detect the amount of the projecting allowance of the wire with respect to pressure connection, and a required measure is adopted if the projecting allowance is insufficient, thereby making it possible to prevent the occurrence of a product with faulty pressure connection.

Further, when the wire is conveyed to one wire pressure-connecting section by two conveying chucks corresponding to both ends of the wire harness, if the end portion of the wire projecting from each of the end conveying chucks positioned at the wire pressure-connecting section is clamped by the wire curvature correcting chuck, it is possible to improve the pressure connection of both ends of the wire harness by using one wire curvature correcting device.

What is claimed is:

1. A wire curvature correcting device in a pressure connection of a wire for use with a pallet that supports a pressure contact terminal, comprising:

a wire setting section;

an end chuck attached to the wire setting section, the wire being directed by the end chuck to a fixed position with respect to the wire setting section and pallet; and a wire curvature correcting chuck which clamps an end portion of the wire and slides in a pulling direction along a surface of a sheathing of the wire to modify a curvature in the wire after the wire is directed by the end chuck to the fixed position with respect to the wire setting section and pallet, prior to the wire being pressed and assembled into the pressure-contact terminal at said fixed location.

2. The wire curvature correcting device in the pressure connection of a wire according to claim 1, further comprising:

an opening/closing sensor provided for said chuck which detects whether or not said chuck has clamped the end portion of the wire, and it is determined based on the detection output of said sensor whether a projecting allowance of the wire is sufficient or insufficient.

3. The wire curvature correcting device in the pressure connection of a wire according to claim 2, wherein, when the wire is conveyed to a wire pressure-connecting section by two conveying chucks corresponding to both ends of a wire harness, the end portion of the wire projecting from each of said conveying chucks positioned at said wire pressure-connecting section is clamped by said wire curvature correcting chuck.

4. The wire curvature correcting device in the pressure connection of a wire according to claim 1, wherein, when the wire is conveyed to a wire pressure-connecting section by two end chucks corresponding to both ends of a wire harness, the end portions of the wire projecting from each of said end chucks positioned at said wire pressure-connecting section is clamped by said wire curvature correcting chuck.

* * * * *